United States Patent [19]

Neiman

[11] Patent Number: 4,807,806

[45] Date of Patent: Feb. 28, 1989

[54] DISPLAY-MAILER ASSEMBLY

[76] Inventor: Conrad Neiman, P.O. Box 31143, Charleston, S.C. 29417

[21] Appl. No.: 131,923

[22] Filed: Dec. 11, 1987

[51] Int. Cl.[4] ..... B42D 15/00

[52] U.S. Cl. ..... 229/92.8; 229/71; 383/84; 206/0.81; 206/45.33; 206/232; 206/466

[58] Field of Search ..... 229/92.8, 92.3, 71; 206/45.33, 632, 466, 232, 0.81; 383/84, 86, 9

[56] References Cited

U.S. PATENT DOCUMENTS

| | | | |
|---|---|---|---|
| 2,728,515 | 12/1955 | Haire | 229/71 |
| 3,255,869 | 6/1966 | Keller | 206/232 X |
| 3,307,281 | 3/1967 | Mateo | 206/466 X |
| 3,662,878 | 5/1972 | Conrad | 206/45.33 |
| 4,570,416 | 2/1986 | Shoenfeld | 229/71 X |
| 4,715,728 | 12/1987 | Sfikas | 383/9 |

*Primary Examiner*—Stephen Marcus
*Assistant Examiner*—Nova Stucker
*Attorney, Agent, or Firm*—Warren B. Kice

[57] ABSTRACT

A display-mailer assembly in which a display card, having an object to be displayed fastened thereto, is inserted in an outer envelope of a transparent material for containing the display card during display. The envelope is quick-detachably fastened to retain the display card in the envelope and manually activated adhesive is provided on the envelope to enable the display card to be sealed in the envelope after it has been removed therefrom and addressed, to enable the assembly to be mailed.

23 Claims, 2 Drawing Sheets

DISPLAY-MAILER ASSEMBLY

BACKGROUND OF THE INVENTION

This invention relates to a display-mailer assembly and, more particularly, to such an assembly in which an object can be displayed and mailed in an efficient and convenient manner.

Collectible objects, such as coins, medals, medallions etc. are becoming more and more popular. However one problem exists in the display of these type collectibles. This problem stems from the fact that the shoppers, or potential purchasers, have to buy the object from a display counter, or the like, and if it is desired to ship or mail the object to a friend, a separate envelope or package must be used. Since the object and/or the card in which it is displayed is usually initially marketed in an envelope and the object, when mailed, is inserted in another envelope, this is an inconvenience to the purchaser, and a waste of resources.

SUMMARY OF THE INVENTION

It is therefore an object of the present invention to provide a display-mailer assembly which eliminates the need for a separate envelope or package when mailing the purchased object.

It is a further object of the present invention to provide an assembly of the above type in which the same envelope utilized to display the object can also be utilized to mail same.

Toward the fulfillment of these and other objects the display-mailer assembly of the present invention includes a display card having a display side for receiving the object to be displayed and sold, and a side for receiving an address. An outer envelope of a transparent material contains the display card, and means are provided for quick detachably fastening the envelope to retain the display card in the envelope, during display. Manually activated adhesive means are also provided on the envelope to enable the display card to be sealed in the envelope after it has been removed therefrom and addressed, to enable the assembly to be mailed.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
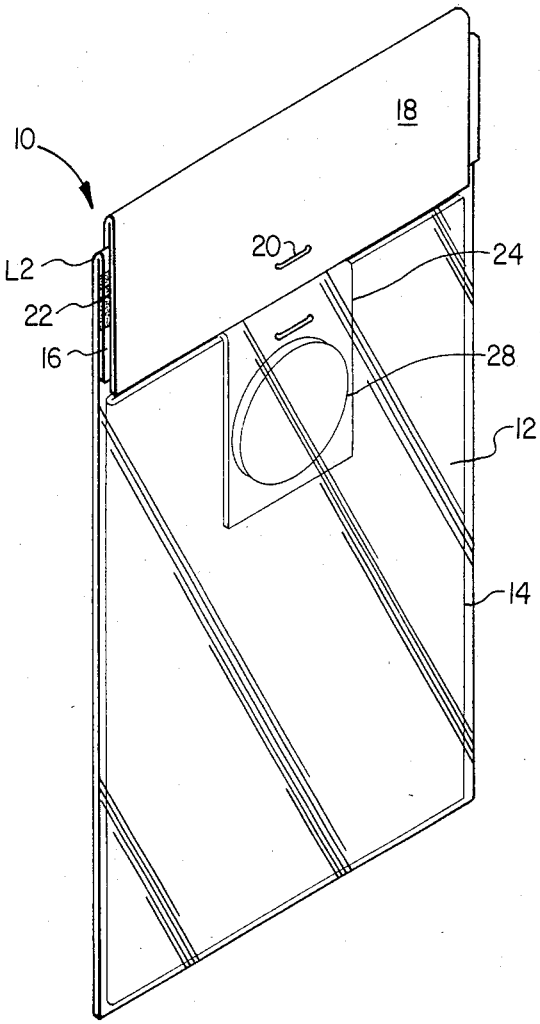
FIG. 1 is a perspective view of the assembly of the present invention.
Figure 2:
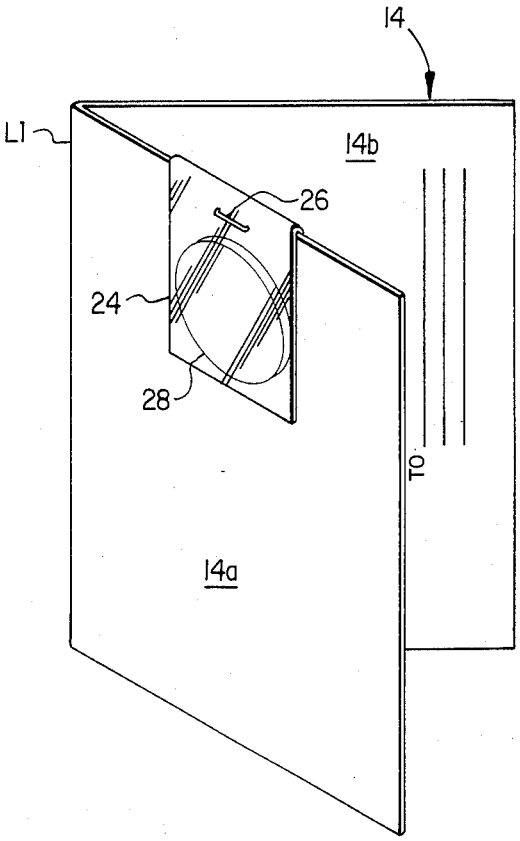
FIG. 2 is a perspective view of the display card of the assembly of FIG. 1 shown removed from the outer envelope.

Referring to FIGS. 1 and 2 of the drawings, the reference numeral 10 refers, in general, to the assembly of the present invention which includes an outer envelope 12 of a transparent material. Contained within the envelope 12 is a card 14 that is folded about a line L1 halfway between its two ends to form two portions 14*a* and 14*b*. The envelope 12 has one open end, and a flap 16 formed integrally with the envelope extends over the open end in one of two positions. In the position shown in FIG. 1 the flap 16 is folded about a line L2 approximately halfway between its ends.

A folded header card 18 extends over the folded flap 16 and is fastened thereto by a staple 20, or any other quick-detachable device, to secure the card 14 in the envelope 12 during display. An adhesive strip 22 is disposed on the folded portion of the flap 16 and consists of an adhesive material disposed between the flap and a strip of transparent material identical to that of the flap so that, when the strip is removed, the adhesive material is exposed. This strip 22 functions in a manner to be described in detail.

A relatively small transparent envelope 24 is fastened to the card portion 14*a* by a staple 26, or any other conventional quick-detachable device. A portion of the envelope 24 drapes over the rear surface of the card portion 14*a* so that it also can be secured to the card portion by the staple 26. The main portion of the envelope drapes over the front surface of the card portion 14*a* and contains the object to be displayed, which in this example is a coin 28.

Figure 3:
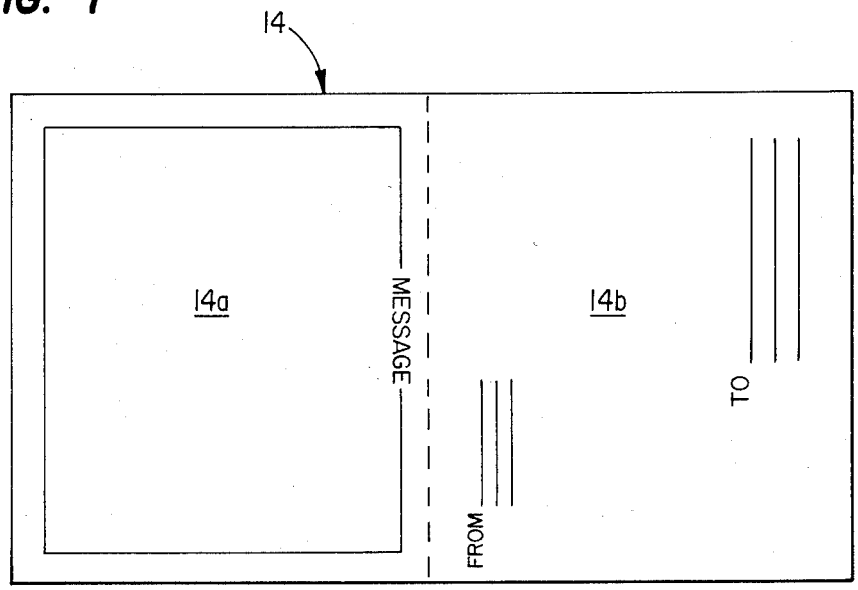
FIG. 3 is an elevational view depicting the display card of FIG. 2 in its unfolded position.

As shown in FIG. 3, the rear surface of the card portion 14*a* contains a margin and the identification "MESSAGE", while the front surface of the card portion 14*b* provides lines for insertion of the name and address of the addressor and the addressee. It is understood that the header card 18, the front surface of the card portion 14*a*, and the rear surface of the card portion 14*b* can be printed with advertising, descriptive or identifying data relating to the object to be displayed.

The assembly 10 is displayed and sold in the format shown in FIG. 1, i.e. with the small envelope 24 containing the coin 28 fastened to the card portion 14*a*, with the card 14 extending within the envelope 12 and with the header card 18 secured over the folder flap 16. The assembly 10 can be displayed in any conventional manner such as by stacking a plurality of assemblies on a counter, or hanging the assemblies on display rods, in which case holes would be provided through the header card 18 and the folded flap 16.

After the assembly 10 is purchased, the staple 20 is removed, the header card is discarded, and the card 14, with the envelope 24 attached thereto, is removed. The card 14 is unfolded to the position shown in FIG. 3 and the purchaser fills out the addressee and addressor portion on the front surface of the card portion 14*b*, and inserts a message on the rear surface of the card portion 14*a*, if desired.

Figure 4:
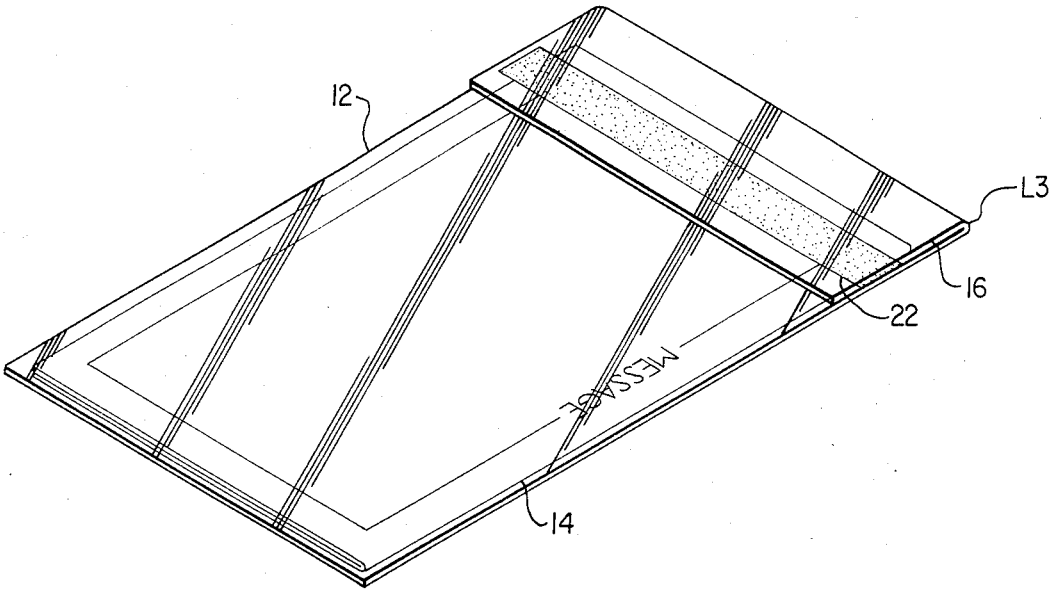
FIG. 4 is a perspective view of the display card after it has been refolded and placed back into the outer envelope.
Figure 5:
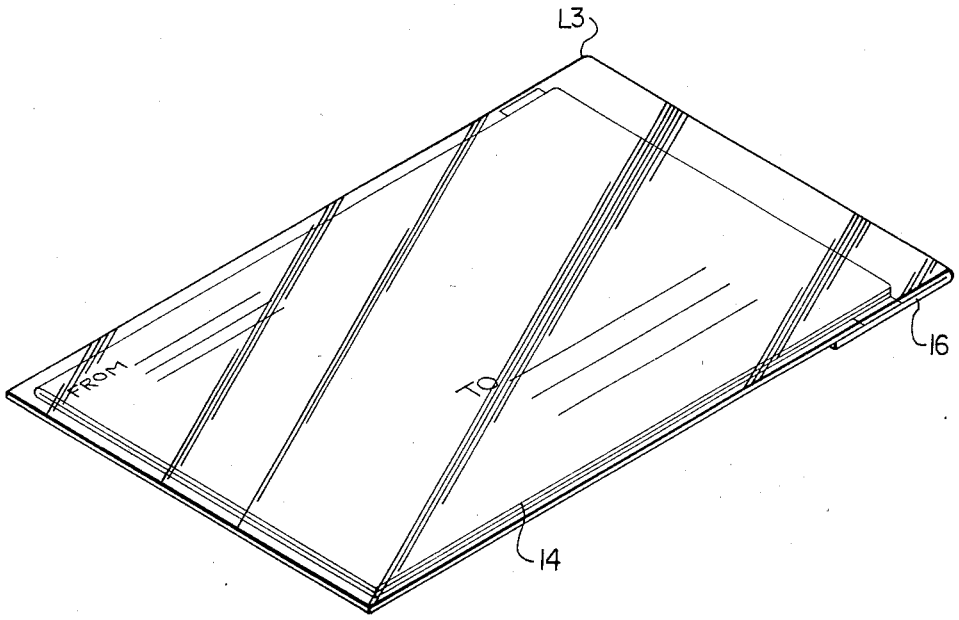
FIG. 5 is a view similar to FIG. 4 but showing the reverse side of the display card and outer envelope.

The card 14 is then folded in an opposite direction to the direction previously folded, and reinserted in the envelope 12 as shown in FIGS. 4 and 5. In this position the envelope 24 and the coin 28 are secured between the front surface of the card portion 14*a* and the rear surface of the card portion 14*b* and are thus unexposed. Also, the rear surface of the card portion 14*a*, having the message inscribed thereon, faces the body, or wall, of the envelope 12 over which the flap 16 extends. The flap 16 is then folded to its second position about the fold line L3 which is the end thereof integral with the body portion of the envelope 12, as shown in FIG. 4.

Prior to this fold, the adhesive strip 22 is pulled off the flap 16 to expose the adhesive to enable the flap to be secured to the wall of the envelope, as shown. The envelope 12 is then turned over and a stamp is placed on the outer wall thereof through which the addressee and addressor portions are visible, as shown in FIG. 5.

It is thus seen that the assembly of the present invention provides several advantages. For example, it enables the purchaser to quickly remove the display card 14 from the outer envelope 12, address same, insert a message, and, after refolding the card to the position shown in FIG. 4, reinsert same in the envelope for mailing, while securing the coin 28 between the card portions 14*a* and 14*b* so that it is unexposed. The present invention thus enables the same outer envelope (12) to be utilized both for display and for mailing which eliminates the need for an extra envelope. Also, the assembly of the present invention provides ample room for advertising, descriptive or identifying data to be placed on the header card, and/or the front surface of the card portion 14*a* and/or the rear surface of the card portion 14*b*.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A display-mailer assembly comprising:

a display card having a display side and a side for receiving an address, means for attaching an object to be displayed to said display side of said card, an outer envelope of a transparent material for containing said card during display, said envelope having an open end and a flap foldable over said open end, means for quick-detachably fastening said envelope to retain said card in said envelope, and manually activatable adhesive means on said flap to enable said card to be sealed in said envelope after it has been removed therefrom and addressed, to enable said assembly to be mailed, said flap and said adhesive means being constructed and arranged to enable said flap to be folded over said open end to accept said fastening means without activation of said adhesive means and to be folded over said open end with said adhesive means activated to secure the flap to a wall of said envelope.

2. The assembly of claim 1 wherein said fastening means comprises a header card disposed over said flap.

3. The assembly of claim 1 wherein said card is foldable about a line intermediate its ends to form two portions each having two surfaces.

4. The assembly of claim 3 wherein said card is foldable so that said object is unexposed and extends between said two portions.

5. The assembly of claim 3 wherein one of said surfaces receives said object to be displayed, one of said surfaces receives said address and at least one other of said surfaces receives graphics.

6. The assembly of claim 5 wherein said card is foldable so that said surface receiving said object is exposed and so that said address-receiving surface is not exposed.

7. The assembly of claim 5 wherein another of said surfaces receives a message.

8. The assembly of claim 7 wherein said card is foldable so that one of said graphics-receiving surfaces is exposed and said message-receiving surface is not exposed.

9. A display-mailer assembly comprising:

a display card having a display side and a side for receiving an address, means for attaching an object to be displayed to said display side of said card, an outer envelope of a transparent material for containing said card during display, means for quick-detachably fastening said envelope to retain said card in said envelope, and manually activatable adhesive means on said flap to enable said card to be sealed in said envelope after it has been removed therefrom and addressed, to enable said assembly to be mailed, said card being foldable about a line intermediate its ends to form two portions each having two surfaces, said card being foldable so that said object is unexposed and extends between said two portions and being foldable so that said surface receiving said object is exposed and so that said address-receiving surface is not exposed.

10. The assembly of claim 9 wherein said envelope has an open end and a flap extending across said open end.

11. The assembly of claim 10 wherein said adhesive means is disposed on said flap.

12. The assembly of claim 11 wherein said flap and said adhesive means are constructed and arranged to enable said flap to be folded over said open end without activation of said adhesive means and to be folded to accept said fastening means and to be folded over said open end with said adhesive means activated to secure the flap to a wall of said envelope.

13. The assembly of claim 9 wherein said fastening means comprises a header card disposed over said flap.

14. The assembly of claim 9 wherein one of said surfaces receives said object to be displayed, one of said surfaces receives said address and at least one other of said surfaces receives graphics.

15. The assembly of claim 14 wherein another of said surfaces receives a message.

16. The assembly of claim 15 wherein said card is foldable so that one of said graphics-receiving surface is exposed and said message-receiving surface is not exposed.

17. A display-mailer assembly comprising:

a display card having a display side and a side for receiving an address, means for attaching an object to be displayed to said display of said card, an outer envelope of a transparent material for containing said card during display, means for quick-detachably fastening said envelope to retain said card in said envelope, said card being foldable about a line intermediate its ends to form two portions each having two surfaces, one of said surfaces receiving said object to be displayed, one of said surfaces receiving said address, at least one other of said surfaces receiving graphics, and another of said surfaces receiving a message, wherein said card is foldable so that one of said graphics-receiving surface is exposed and said message-receiving surface is not exposed, and manually activatable adhesive means on said envelope to enable the said card to be sealed in said envelope after it has been removed therefrom and addressed, to enable said assembly to be mailed.

18. The assembly of claim 17 said envelope has an open end and a flap extending across said open end.

19. The assembly of claim 18 wherein said adhesive means is disposed on said flap.

20. The assembly of claim 19 wherein said flap and said adhesive means are constructed and arranged to enable said flap to be folded over said open end without activation of said adhesive means and to be folded to accept said fastening means and to be folded over said open end with said adhesive means activated to secure the flap to a wall of said envelope.

21. The assembly of claim 17 wherein said fastening means comprises a header card disposed over said flap.

22. The assembly of claim 17 wherein said card is foldable so that said object is unexposed and extends between said two portions.

23. The assembly of claim 22 wherein said card is foldable so that said surface receiving said object is exposed and so that said address-receiving surface is not exposed.

* * * * *